US007597591B2

(12) United States Patent
Leubner

(10) Patent No.: US 7,597,591 B2
(45) Date of Patent: Oct. 6, 2009

(54) CONNECTION SYSTEM

(75) Inventor: Martin Leubner, Mitwitz (DE)

(73) Assignee: CCS Technology, Inc., Wilmington, DE (US)

( * ) Notice: Subject to any disclaimer, the term of this patent is extended or adjusted under 35 U.S.C. 154(b) by 0 days.

(21) Appl. No.: 12/369,788

(22) Filed: Feb. 12, 2009

(65) Prior Publication Data

US 2009/0149082 A1 Jun. 11, 2009

Related U.S. Application Data

(63) Continuation of application No. PCT/EP2007/006788, filed on Aug. 1, 2007.

(30) Foreign Application Priority Data

Aug. 25, 2006 (DE) ..... 20 2006 013 075 U

(51) Int. Cl.
*H01R 24/00* (2006.01)

(52) U.S. Cl. ..... 439/676; 439/23; 439/489; 439/218

(58) Field of Classification Search ..... 439/676, 439/13, 22, 23, 488, 489, 491, 218
See application file for complete search history.

(56) References Cited

U.S. PATENT DOCUMENTS

| | | | | |
|---|---|---|---|---|
| 5,496,196 | A | 3/1996 | Schachtebeck | 439/682 |
| 6,428,325 | B1 * | 8/2002 | Kurosawa et al. | 439/21 |
| 6,524,139 | B1 | 2/2003 | Chang | 439/676 |
| 6,935,877 | B2 * | 8/2005 | Liao | 439/218 |
| 7,021,971 | B2 * | 4/2006 | Chou et al. | 439/218 |
| 2005/0186838 | A1 | 8/2005 | Debenedictis et al. | 439/540.1 |
| 2005/0287873 | A1 | 12/2005 | Carroll et al. | 439/676 |
| 2006/0105619 | A1 * | 5/2006 | Lanni | 439/488 |
| 2006/0121791 | A1 | 6/2006 | Hashim | 439/676 |

FOREIGN PATENT DOCUMENTS

| | | | |
|---|---|---|---|
| CH | 688947 | A5 | 6/1998 |
| EP | 0899829 | A2 | 3/1999 |
| EP | 1624539 | A2 | 2/2006 |
| WO | WO2006/053436 | | 5/2006 |

* cited by examiner

*Primary Examiner*—Tho D Ta
(74) *Attorney, Agent, or Firm*—C. Keith Montgomery

(57) ABSTRACT

A connection system for laying and connecting core pairs of a multi-pair data cable to connection pairs of a data jack with an accommodating device for accommodating and sorting, without crossing over, the core pairs of the data cable.

17 Claims, 5 Drawing Sheets

CONNECTION SYSTEM

RELATED APPLICATIONS

This application is a continuation of to PCT App. PCT/EP2007/006788, filed Aug. 1, 2007, which claims priority to German application DE 20 2006 013 075.6, filed Aug. 25, 2006, the entire contents of both documents being hereby incorporated by reference as if set for herein in their entireties.

TECHNICAL FIELD

The disclosure relates to a connection system for laying and/or connecting core pairs of a multi-pair data cable to connection pairs of a data jack.

BACKGROUND

RJ45 data jacks have four connection pairs for laying and/or connecting core pairs of a four-pair data cable, each connection pair of the data jack being used for laying and/or connecting a core pair of the data cable. In order to facilitate the connection of the core pairs of the data cable to the connection pairs of the data jack, color coding is assigned to the connection pairs of the data jack, which color coding corresponds to the colored sheathing of the cores of the core pairs of the data cable. The color coding is in this case carried out in accordance with the standard TIA/EIA 568 A or the standard TIA/EIA 568 B. When the core pairs of the data cable are laid on the corresponding connection pairs of the data jack, in accordance with the prior art the cores of at least two core pairs need to cross over one another, which can result in assignment errors or connection errors, in particular when in each case one data jack is intended to be connected to two opposite ends of a data cable, since the core pairs at the different ends of a data cable are each arranged in mirror-image fashion with respect to one another, when viewed in the viewing direction of the corresponding end of the data cable. Furthermore, crossing over the cores of different core pairs can impair the electrical transmission capacity. There is therefore a need for a connection system for connecting core pairs of a multi-pair data cable to connection pairs of a data jack which can be used to lay the core pairs of the data cable on the connection pairs of the data jack in a simplified and failsafe manner.

SUMMARY

According to one embodiment, a connection system comprises: an accommodating device for accommodating and sorting, without crossing over, the core pairs of the data cable, the core pairs being accommodated in the accommodating device in such a way that they are offset with respect to one another and in such a way that a first core of all of the core pairs, when viewed in the clockwise direction or in the counterclockwise direction, is arranged in each case on the same side of a second core of the respective core pair; an assignment device, which has, on a first side, first connection pairs for making electrically conductive contact between them and the core pairs of the data cable which are accommodated in the accommodating device and, on a second side, second connection pairs for making electrically conductive contact between them and connection pairs of the data jack, the connections of the first connection pairs and of the second connection pairs of the assignment device being electrically conductively linked to one another; the contact-making between the core pair, which is accommodated and sorted in the accommodating device, of the data cable and the connection pairs of the data jack being determined by the relative rotary position between the accommodating device, the data jack and the assignment device, which is connected therebetween.

According to one aspect of the embodiment, it is possible to lay, without crossing over, and/or connect core pairs of a multi-pair data cable to the connection pairs of a data jack, with the actual contact being made between the core pairs of the data cable and the connection pairs of the data jack with the assignment device interposed, the relative rotary position of which assignment device with respect to the accommodating device and the data jack determines the contact-making between the core pairs of the data cable and the connection pairs of the data jack. As a result, assignment errors or connection errors when laying the core pairs of the data cable on the connection pairs of the data jack can be avoided, and furthermore the electrical transmission power is not reduced by the laying of the core pairs of the data cable without them being crossed over.

Preferably, the assignment device and the data jack have first markings, which determine the relative rotary position of the data jack with respect to the assignment device, the data jack and the accommodating device having second markings, which determine the relative rotary position of the accommodating device with respect to the data jack and therefore with respect to the assignment device.

BRIEF DESCRIPTION OF THE FIGURES

Exemplary embodiments of the invention, without the invention being restricted thereto, are explained in more detail with reference to the drawing, in which.

DETAILED DESCRIPTION

The present embodiments related to a connection system for laying and/or connecting core pairs of a multi-pair data cable to connection pairs of a data jack, it being assumed below that the data jack is in the form of an RJ45 data jack with four connection pairs for connecting four core pairs of a data cable.

The principles of the present embodiments are not restricted to the use of RJ45 data jacks, but can instead be used on any desired data jacks which are to be connected to multi-pair data cables.

The connection system according substantially comprises three main components, namely an accommodating device 10 for accommodating and sorting the cable cores of a data cable 11, an assignment device 12 and a data jack 13, in the fitted state the assignment device 12 being arranged between the accommodating device 10 and the data jack 13.

Figure 1:
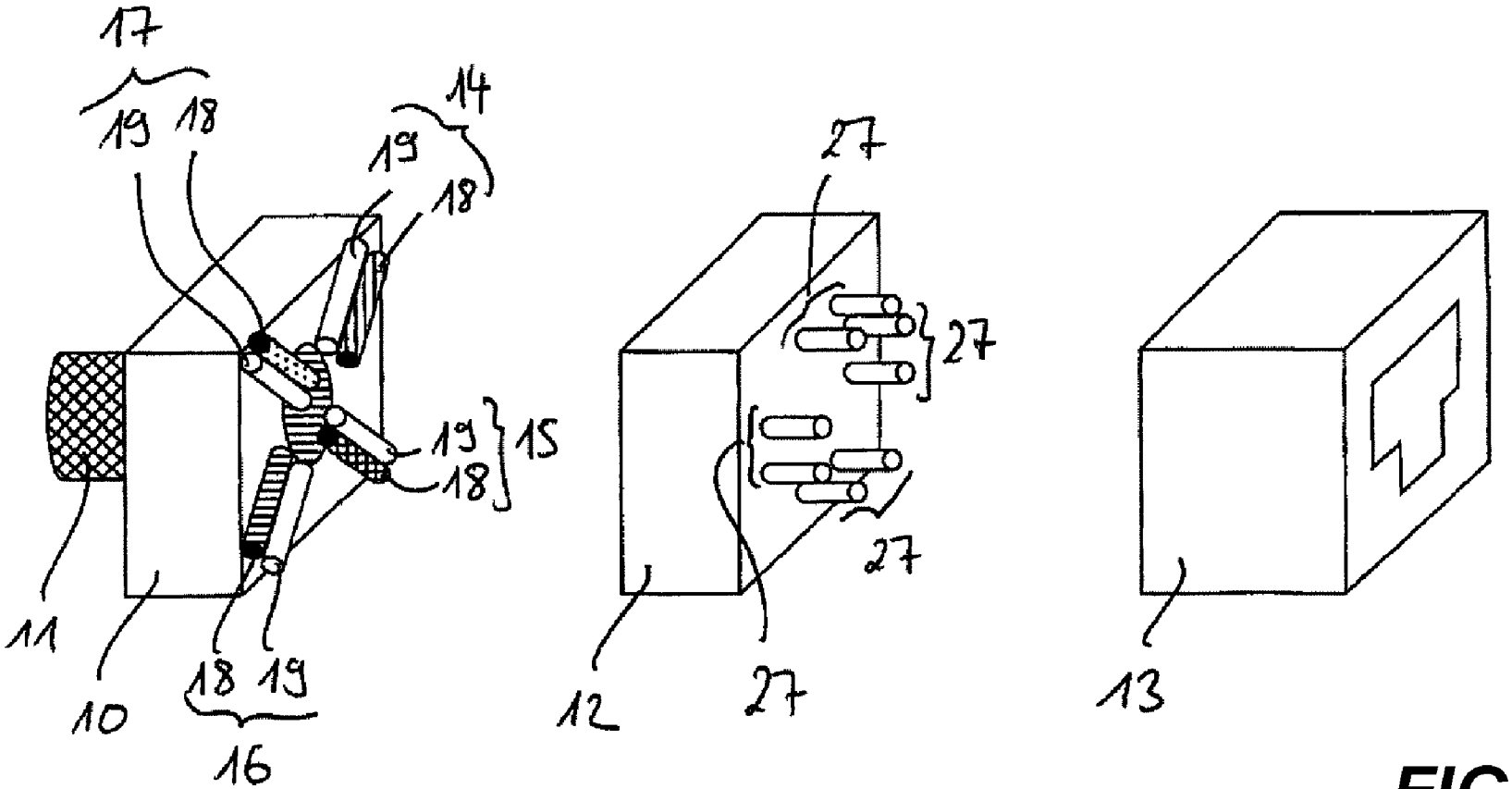
FIG. 1 shows a first schematized illustration of a connection system according to an embodiment of the invention for laying and/or connecting core pairs of a multi-pair data cable to core pairs of a data jack comprising an accommodating device with a data cable, an assignment device and the data jack.

The accommodating device 10 is used for accommodating and sorting, without crossing them over, core pairs of the data cable 11, in accordance with FIG. 1 the data cable 11 comprising in total four core pairs 14, 15, 16 and 17 each comprising two cores, namely in each case a first core 18 and a second core 19. In this case, the core pairs 14 to 17 of the data cable 11 can be sorted, without being crossed over, in the accommodating device 10 in such a way that, when viewed in the clockwise direction or in the counterclockwise direction, the first core 18 of each core pair 14 to 17 is arranged in each case on the same side of the second core 19 of the respective core pair 14 to 17. As shown in FIG. 1, the core pairs 14 to 17 are offset rotationally symmetrically with respect to one another through in each case 90° in the position in which they are accommodated and sorted in the accommodating device 10.

Figure 2:
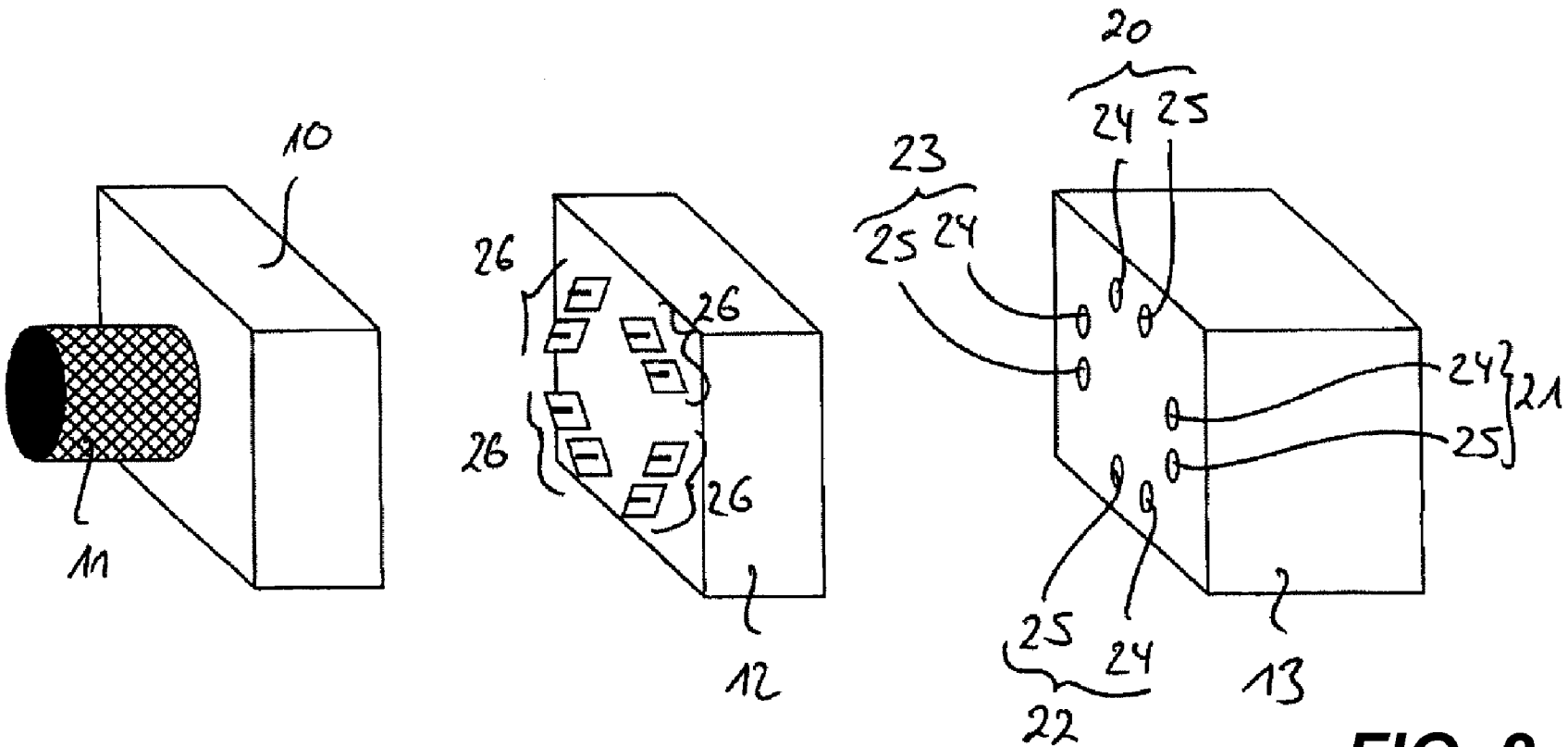
FIG. 2 shows a second schematized illustration of the connection system according to the embodiment of FIG. 1 for laying and/or connecting the core pairs of the multi-pair data cable to the connection pairs of the data jack.
Figure 3:
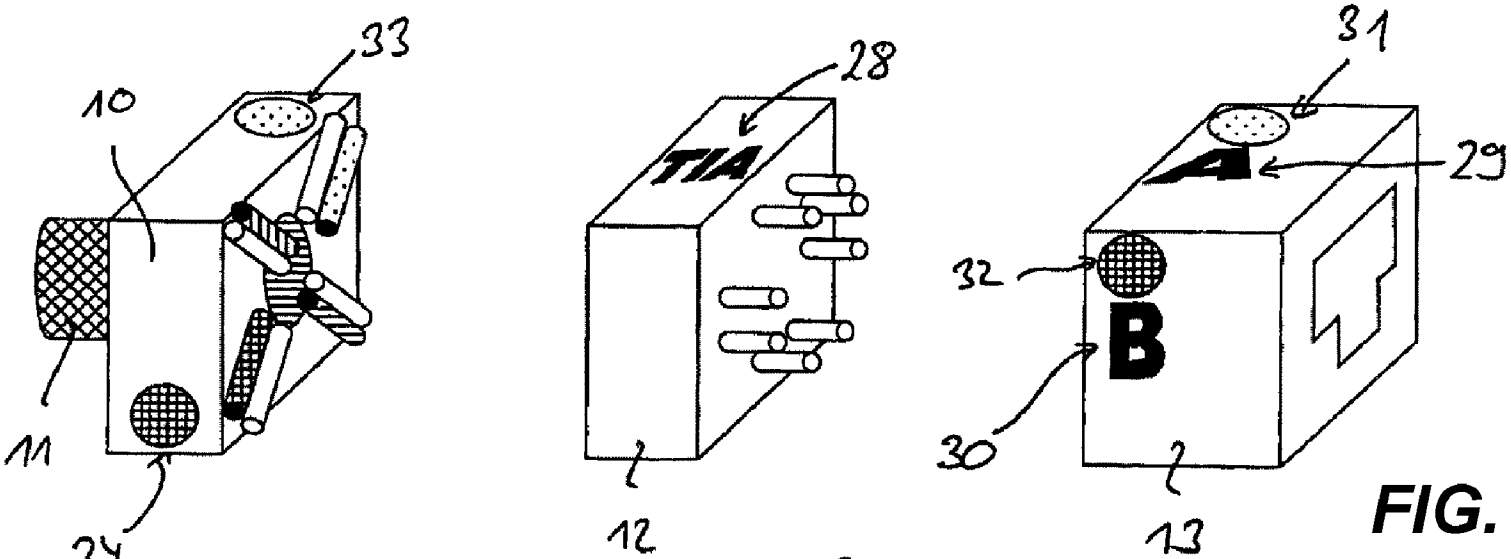
FIG. 3 shows a schematized illustration of the connection system according to an embodiment of the invention for laying and/or connecting core pairs of a multi-pair data cable in accordance with the standard TIA/EIA 568 A at a first end of the data cable to the connection pairs of a data jack.
Figure 4:
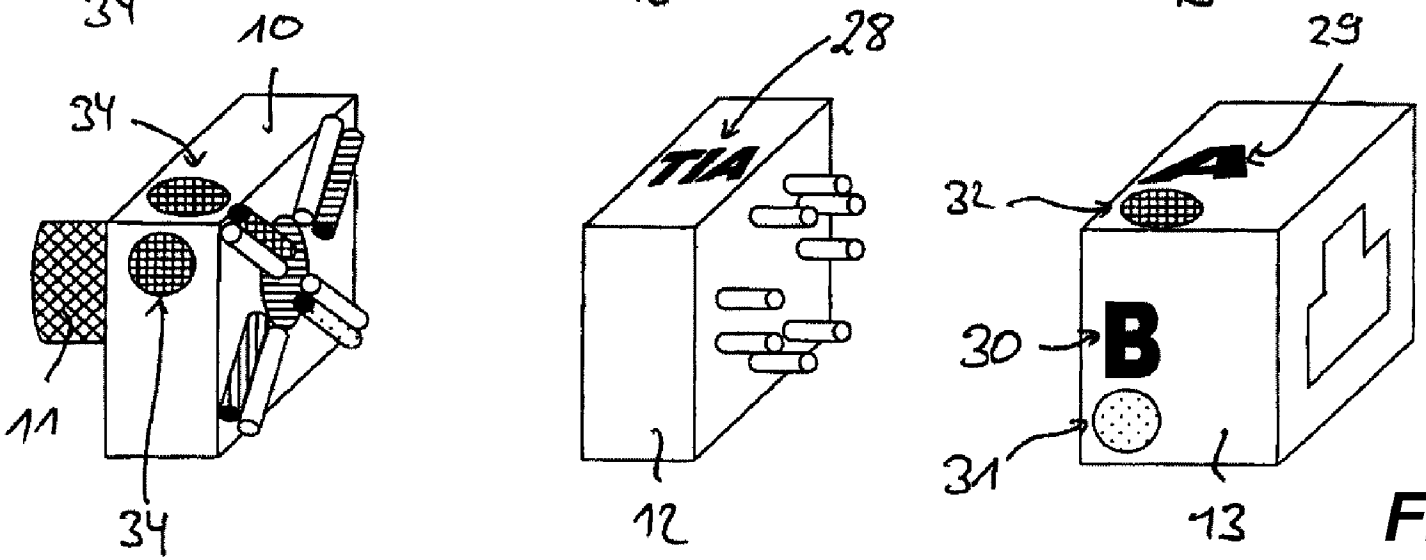
FIG. 4 shows a schematized illustration of the connection system according to an embodiment the invention for laying and/or connecting core pairs of a multi-pair data cable in accordance with the standard TIA/EIA 568 A at a second end of the data cable to the connection pairs of a data jack.
Figure 5:
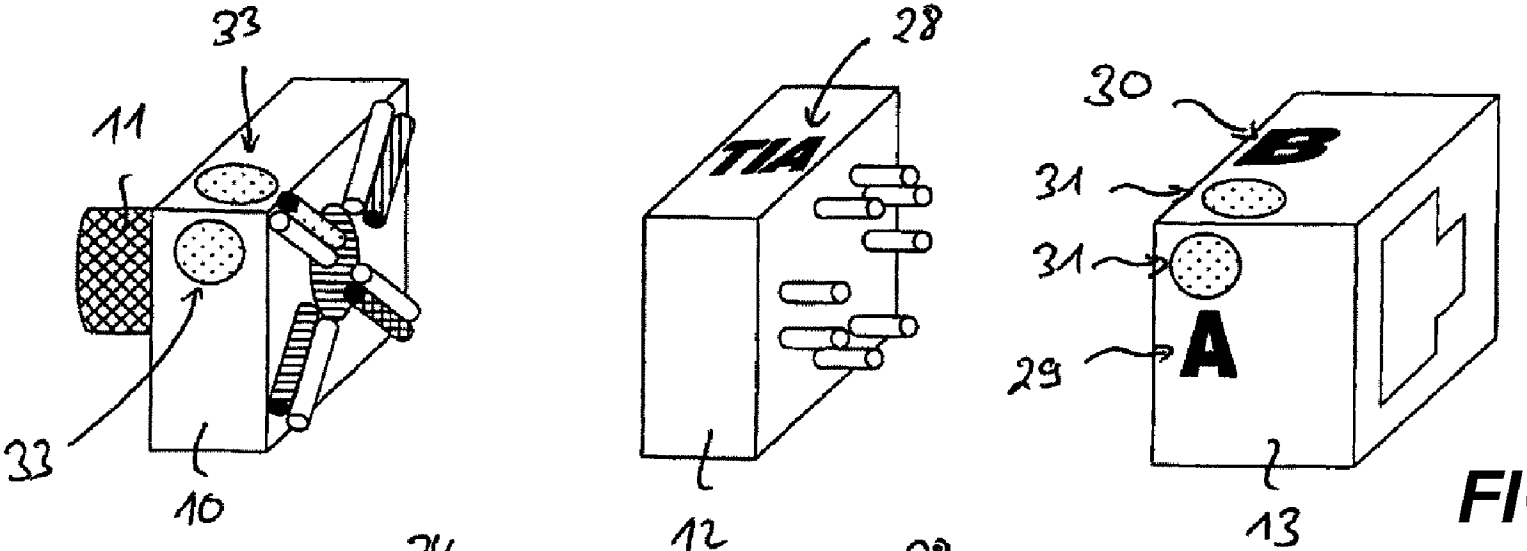
FIG. 5 shows a schematized illustration of a connection system according to an embodiment of the invention for laying and/or connecting core pairs of a multi-pair data cable in accordance with the standard TIA/EIA 568 B at a first end of the data cable to the connection pairs of a data jack.
Figure 6:
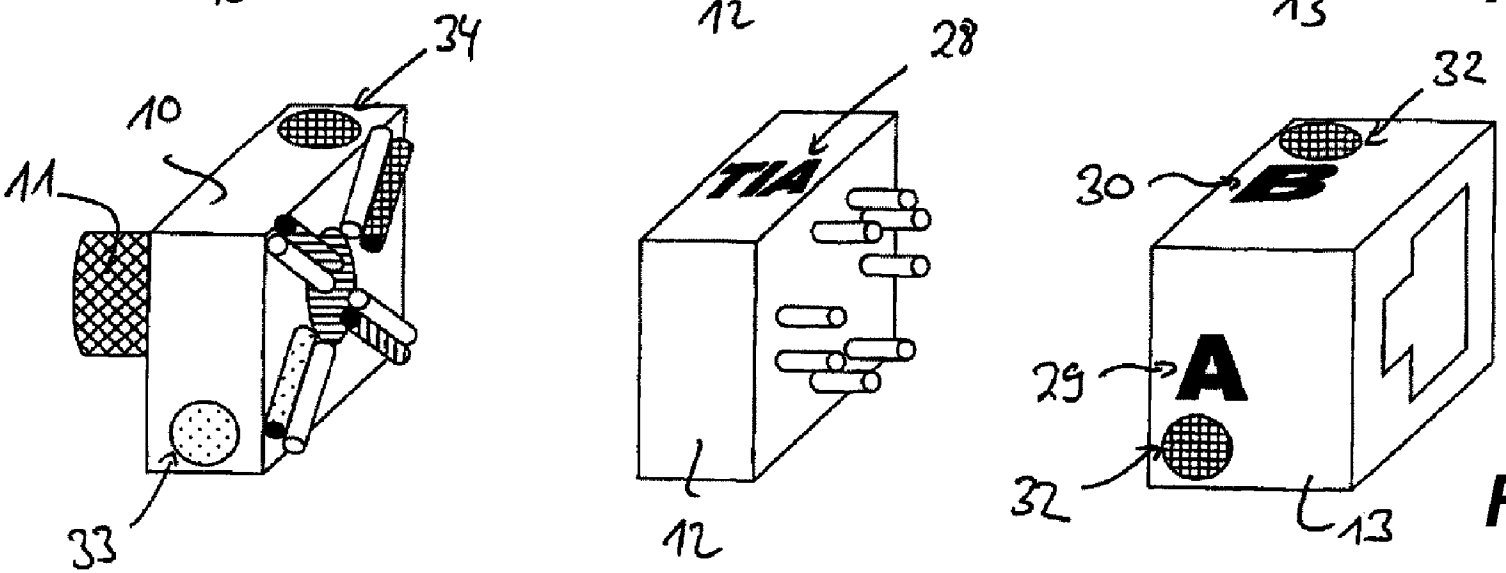
FIG. 6 shows a schematized illustration of a connection system according to an embodiment of the invention for laying and/or connecting core pairs of a multi-pair data cable in accordance with the standard TIA/EIA 568 B at a second end of the data cable to the connection pairs of a data jack.

The data jack 13 has connection pairs, in the exemplary embodiment shown four connection pairs 20, 21, 22 and 23, each comprising two connections, namely a first connection 24 and a second connection 25. The connection pair 20 is in particular the so-called connection pair 1-2 of the data jack 13, the connection pair 21 is the so-called connection pair 4-5, the connection pair 22 is the so-called connection pair 3-6, and the connection pair 23 is the so-called connection pair 7-8, in FIG. 2 the connection pair 20 (connection pair 1-2) being opposite the connection pair 22 (connection pair 3-6) and the connection pair 21 (connection pair 4-5) being opposite the connection pair 23 (connection pair 7-8).

The cores 8, 19 of the core pairs 14 to 17 of the data cable 11 are now connected to the connections 24, 25 of the connection pairs 20 to 23 of the data jack 13, to be precise in such a way that, depending on the end of the cable to which a data jack is to be connected, and depending on the standard used for laying the core pairs, i.e. depending on the standard TIA/EIA 568 A or the standard TIA/EIA 568 B, the cores of the core pairs 14 to 17 are connected to the correct connections 24, 25 of the connection pairs 20 to 23. The assignment device 12 of the connection system according to the invention is used for this purpose.

The assignment device 12 has, on a first side, first connection pairs 26 and, on a second side, second connection pairs 27, the first connection pairs 26 being used for making electrical contact between them and the core pairs 14 to 17 of the data cable 11, and the second connection pairs 27 being used for making electrical contact between them and the connection pairs 20 to 23 of the data jack 13.

Figure 7:
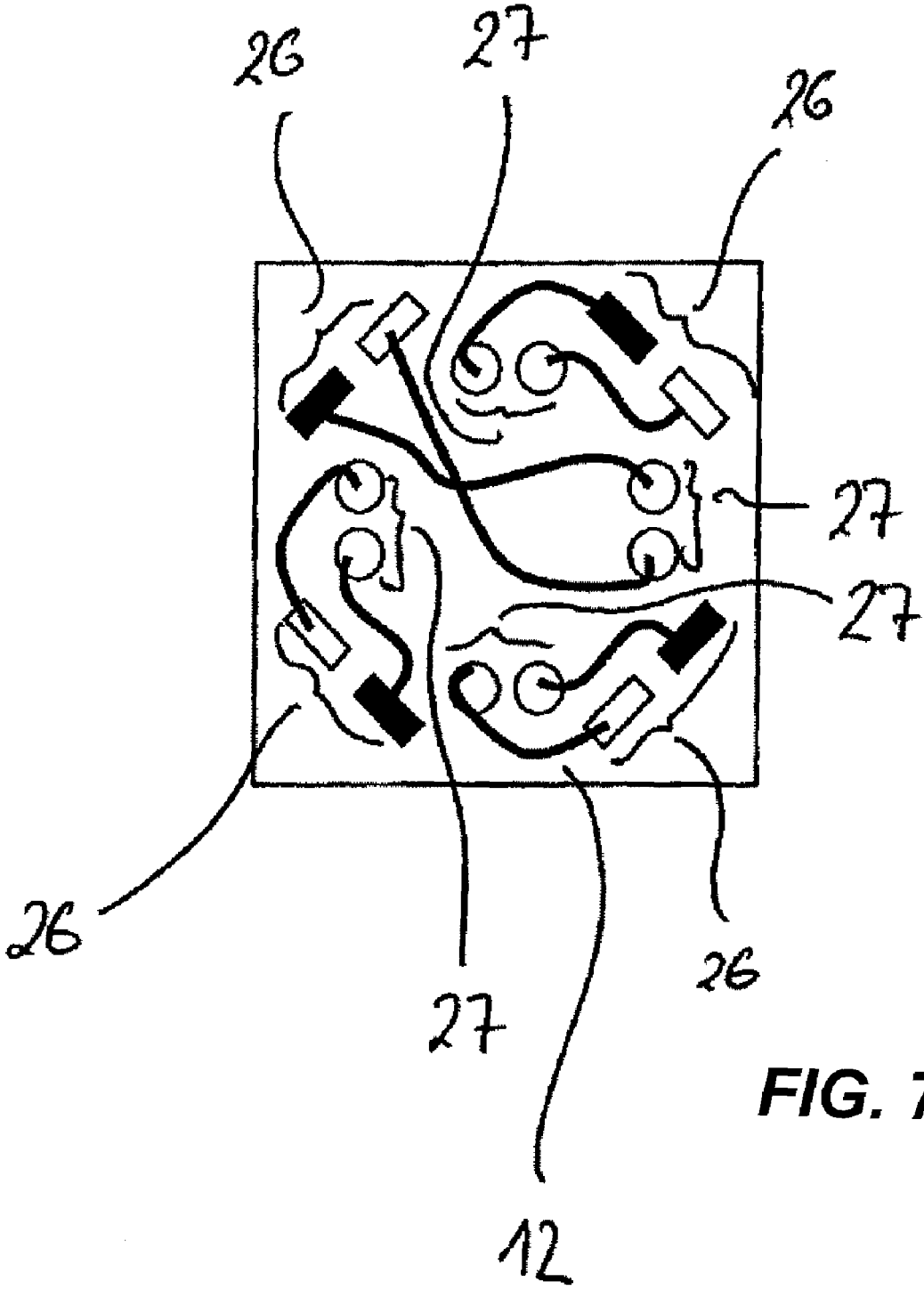
FIG. 7 shows a schematized view of the assignment device of the connection system.

According to FIG. 7, the connections of the first connection pairs 26 and the connections of the second connection pairs 27 of the assignment device 12 are electrically conductively linked to one another, the links between the connections of the first connection pairs 26 and the connections of the second connection pairs 27 of the assignment device 12 being capable of being shielded from one another in pairs, namely in pairs of cores.

The contact-making between the core pairs 14 to 17, which are accommodated and sorted, without being crossed over, in the accommodating device 10, of the data cable 11 and the connection pairs 20 to 23 of the data jack 13 is determined by the relative rotary position between the accommodating device 10, the assignment device 12 and the data jack 13, for this purpose in particular the accommodating device 10 being capable of being rotated relative to the assignment device 12 and the data jack 13 being capable of being rotated relative to the assignment device 12.

The correct relative rotary position between the accommodating device 10, the assignment device 12 and the data jack 13 is predetermined for the respective end of a data cable and for the respective standard used for laying the core pairs, i.e. for the standard TIA/EIA 568 A or the standard TIA/EIA 568 B, by markings which are assigned to the accommodating device 10, the assignment device 12 and the data jack 13. These markings are shown in FIGS. 3-6.

In this case, the assignment device 12 and the data jack 13 have first markings, which determine the relative rotary position of the data jack 13 with respect to the assignment device 12. The data jack 13 and the accommodating device 10 have second markings, which determine the relative rotary position of the accommodating device 10 with respect to the data jack and therefore with respect to the assignment device 12.

According to FIGS. 3-6, the assignment device 12 has a single first marking 28, which in the exemplary embodiment shown is in the form of a "TIA". In contrast, the data jack 13 has a plurality of first markings 29 and 30, namely the first markings "A" and "B", which are applied to different sides of the data jack 13. By rotating the data jack 13 relative to the assignment device 12, either a first marking 29 of the data jack 13 (i.e. a marking "A") or a first marking 30 of the data jack 13 (i.e. a marking "B") is aligned with the first marking 28 of the assignment device 12, namely in such a way that the first markings of the assignment device 12 and the data jack 13 complement one another in the same plane, namely in FIGS. 3 and 4 the first markings 28 and 29 and in FIGS. 5 and 6 the first markings 28 and 30. Accordingly, in FIGS. 3 and 4 the standard TIA/EIA 568 A and in FIGS. 5 and 6 the standard TIA/EIA 568 B is used for laying the core pairs 14 to 17 of the data cable 11 on the connection pairs 20 to 23 of the data jack 13.

As can furthermore be seen in FIGS. 3-6, a second marking 31 and 32, respectively, is assigned to each first marking 29 and 30, respectively, of the data jack 13. These second markings 31, 32 of the data jack 13 are used for determining the relative rotary position of the accommodating device 10 relative to the data jack 13 and therefore relative to the assignment device 12, with corresponding second markings 33 and 34, respectively, being assigned to the accommodating device 10.

The accommodating device 10 needs to be rotated relative to the data jack 13 in such a way that a second marking 31 and 32, respectively, of the data jack 13 is brought so as to coincide with a corresponding second marking 33 and 34, respectively, of the accommodating device 10, to be precise in such a way that the second markings 31 and 33 and, respectively, 32 and 34 which are assigned to the same core pair, of the data jack 13 and the accommodating device 10 lie in the same plane as the complementary first marking 28 and 29 and, respectively, 28 and 30 of the assignment device 12 and the data jack 13, to be precise on the same edge or on the same side as the first marking 28, 29 and, respectively, 28, 30. This is shown in FIGS. 3-6 for the two different ends of a data cable 11 in each case for both connection standards.

The second markings 33 and 34 of the accommodating device 10 correspond to markings of the core pairs, these second markings 33 and 34 predetermining the laying and/or accommodation of the core pairs, without them being crossed over, in the accommodating device 10. The core pairs are to be laid in the accommodating device 10 in such a way that they are laid in the accommodating positions predetermined by the second markings 33 and 34 of the accommodating device 10 without being crossed over.

The first connection pairs 26 of the assignment device 12 are preferably in the form of IDC contacts (insulation displacement contacts), whereas the second connection pairs 27 of the assignment device 12 are preferably in the form of pin contacts. The second connection pairs 27 in the form of pin contacts of the assignment device 12 protrude in the fitted state into the connection pairs 20 to 23, which are preferably in the form of jacks, of the data jack 13 and are in electrically conductive contact therewith.

In the fitted state of the connection system, the first connection pairs 26, which are in the form of IDC contacts, of the assignment device 12 are used to make electrically conductive contact with the core pairs 14 to 17 of the data cable 11.

The assignment device 12 is preferably mounted rotatably on the data jack 13 in such a way that it cannot become detached. Possibly, forced guidance between the data jack 13 and the assignment device 12 can be provided, in which case laying of the core pairs either in accordance with the standard TIA/EIA 568 A or in accordance with the standard TIA/EIA 568 B is permitted, depending on the forced guidance. In this case, different assignment devices 12 are then required for the respective connection standards.

What is claimed is:

1. A connection system for laying and/or connecting core pairs of a multi-pair data cable to connection pairs of a data jack, comprising:

an accommodating device for accommodating and sorting, without crossing over, the core pairs of the data cable, the core pairs being accommodated in the accommodating device so that that they are offset with respect to one another and so that a first core of all of the core pairs, when viewed in the clockwise direction or in the counterclockwise direction, is arranged in each case on the same side of a second core of the respective core pair; and an assignment device, comprising:

on a first side, first connection pairs for making electrically conductive contact between them and the core pairs of the data cable which are accommodated in the accommodating device; and on a second side, second connection pairs for making electrically conductive contact between them and connection pairs of the data jack, the connections of the first connection pairs and of the second connection pairs of the assignment device being electrically conductively linked to one another, wherein the contact-making between the core pair, which is accommodated and sorted in the accommodating device, of the data cable and the connection pairs of the data jack being determined by the relative rotary position between the accommodating device, the data jack and the assignment device, which is connected therebetween.

2. The connection system of claim 1, wherein the assignment device and the data jack comprise first markings that determine the relative rotary position of the data jack with respect to the assignment device, and in that the data jack and the accommodating device comprise second markings that determine the relative rotary position of the accommodating device with respect to the data jack and therefore with respect to the assignment device.

3. The connection system of claim 1, wherein the connection system is matched to the connection pairs of the data jack for the purpose of laying the core pair of a four-pair data cable in such a way that the core pairs are each accommodated in the accommodating device in such a way that they are offset with respect to one another by approximately ninety degrees.

4. The connection system of claim 3, wherein the data jack is an RJ45 data jack, the connection pairs of the data jack being positioned in such a way that a connection pair 1-2 is opposite a connection pair 3-6 and a connection pair 4-5 is opposite a connection pair 7-8.

5. The connection system of claim 2, wherein the assignment device includes a single first marking, and in that the data jack has a plurality of first markings, the plurality of first markings including a marking for laying of the core pair in accordance with standard TIA/EIA 568 A and a marking for laying the core pairs in accordance with standard TIA/EIA 568 B.

6. The connection system of claim 5, wherein, when the intention is for the core pairs to be laid in accordance with the standard TIA/EIA 568 A, the relative rotary position of the data jack with respect to the assignment device is determined in such a way that the corresponding first marking of the data jack is aligned with the first marking of the assignment device.

7. The connection system of claim 6, wherein, when the intention is for the core pairs to be laid in accordance with the standard TIA/EIA 568 B, the relative rotary position of the data jack with respect to the assignment device is determined in such a way that the corresponding first marking of the data jack is aligned with the first marking of the assignment device.

8. The connection system of claim 5, wherein one second marking is assigned to each first marking of the data jack, with a corresponding second marking of the accommodating device being aligned with the second marking in order to determine the relative rotary position of the accommodating device with respect to the data jack and therefore with respect to the assignment device.

9. The connection system of claim 7, wherein one second marking is assigned to each first marking of the data jack, with a corresponding second marking of the accommodating device being aligned with the second marking in order to determine the relative rotary position of the accommodating device with respect to the data jack and therefore with respect to the assignment device.

10. The connection system of claim 1, wherein the first connection pairs of the assignment device are formed by IDC contacts and the second connection pairs of the assignment device are formed by pin contacts, the IDC contacts of the assignment device being used to make electrically conductive contact with the core pairs, which are accommodated in the accommodating device, of the data cable, and the connections of the connection pairs of the data jack being used to make electrically conductive contact with the pin contacts of the assignment device.

11. The connection system of claim 3, wherein the first connection pairs of the assignment device are formed by IDC contacts and the second connection pairs of the assignment device are formed by pin contacts, the IDC contacts of the assignment device being used to make electrically conductive contact with the core pairs, which are accommodated in the accommodating device, of the data cable, and the connections of the connection pairs of the data jack being used to make electrically conductive contact with the pin contacts of the assignment device.

12. The connection system of claim 5, wherein the first connection pairs of the assignment device are formed by IDC contacts and the second connection pairs of the assignment device are formed by pin contacts, the IDC contacts of the assignment device being used to make electrically conductive contact with the core pairs, which are accommodated in the accommodating device, of the data cable, and the connections of the connection pairs of the data jack being used to make electrically conductive contact with the pin contacts of the assignment device.

13. The connection system of claim 1, wherein links between the connections of the first connection pairs and the connections of the second connection pairs of the assignment device are shielded from one another in pairs.

14. The connection system of claim 3, wherein links between the connections of the first connection pairs and the connections of the second connection pairs of the assignment device are shielded from one another in pairs.

15. The connection system of claim 5, wherein links between the connections of the first connection pairs and the connections of the second connection pairs of the assignment device are shielded from one another in pairs.

16. The connection system of claim 1, wherein the assignment device is mounted rotatably on the data jack in such a way that it cannot become detached.

17. The connection system of claim 4, wherein the assignment device includes a single first marking, and in that the data jack has a plurality of first markings, the plurality of first markings including a marking for laying of the core pair in accordance with standard TIA/EIA 568 A and a marking for laying the core pairs in accordance with standard TIA/EIA 568 B.

* * * * *